US005269106A

United States Patent [19]

Stafford et al.

[11] Patent Number: 5,269,106

[45] Date of Patent: Dec. 14, 1993

[54] MODULAR BUILDING STRUCTURE

[75] Inventors: Robert Stafford, Weed, Calif.; Tom Ruprecht, Sarasota, Fla.; Cary Rapoport, Westlake Village, Calif.

[73] Assignee: Fast Truss, Inc., Weed, Calif.

[21] Appl. No.: 795,927

[22] Filed: Nov. 20, 1991

[51] Int. Cl.[5] ..... E04H 15/00; E04B 1/32

[52] U.S. Cl. ..... 52/63; 52/86; 52/222; 135/102

[58] Field of Search ..... 52/63, 86, 222, 639, 52/641, 644, 643, 690, 691, 692, 693, 694, 695; 135/102, 109, 906, 908

[56] References Cited

U.S. PATENT DOCUMENTS

| | | | |
|---|---|---|---|
| Re. 30,044 | 7/1979 | Huddle | 52/86 X |
| 2,225,972 | 12/1940 | Brogren | 135/906 X |
| 2,500,940 | 3/1950 | Fischer et al. | 52/694 |
| 2,963,127 | 12/1960 | Manville | 52/693 |
| 3,872,634 | 3/1975 | Seaman | 52/63 X |
| 3,953,955 | 5/1976 | Huddle | 135/102 X |
| 3,973,364 | 8/1976 | Seaman | 135/102 X |
| 4,028,861 | 6/1977 | Huddle | 52/86 X |
| 4,036,244 | 7/1977 | Huddle | 52/86 X |
| 4,118,904 | 10/1978 | Sprung | 135/102 X |
| 4,137,687 | 2/1979 | Sprung | 52/222 X |
| 4,373,305 | 2/1983 | Russell | 52/64 X |
| 4,567,696 | 2/1986 | Malet | 52/222 X |
| 4,583,331 | 4/1986 | Hunt et al. | 52/63 X |
| 4,593,710 | 6/1986 | Stafford et al. | 52/63 X |
| 4,841,688 | 6/1989 | Rinaldi | 52/63 |
| 4,885,877 | 12/1989 | Hunt et al. | 135/102 X |
| 4,974,387 | 12/1990 | Dufour | 52/639 |

OTHER PUBLICATIONS

Irvin Industries Inc "Structures for Industry" catalog 1975.

*Primary Examiner*—David A. Scherbel
*Assistant Examiner*—Robert Canfield
*Attorney, Agent, or Firm*—Charles J. Prescott

[57] ABSTRACT

A modular ground deployable membrane supporting building structure and arched truss member therefor. The building structure incorporates a plurality of truss members supportable vertically in side-by-side arrangement within a ground anchor connectable at each end of each truss member. Each truss member is comprised of a plurality of frame sections each connectable in aligned abutting end-to-end relation. Each frame section is comprised of inner and outer channel members having a unique U-shaped cross section facilitating cross member connection to secure a spaced parallel relation of the channel members, flexible membrane retention and improved strength and reduced deployment time. An improved membrane tensioning arrangement and ground anchor structure facilitating pivotal deployment of each assembled truss member are also provided. Utilization of galvanized cross members in combination with aluminum extruded channel members further improves truss strength while avoiding galvanic deterioration between dissimilar metals.

6 Claims, 5 Drawing Sheets

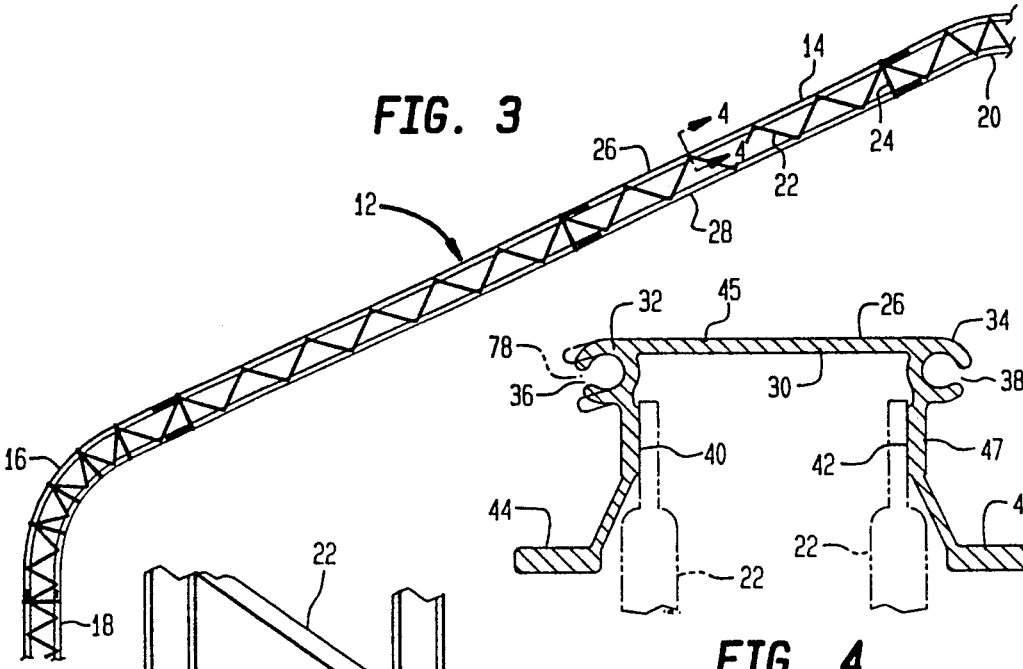
FIG. 3
FIG. 4
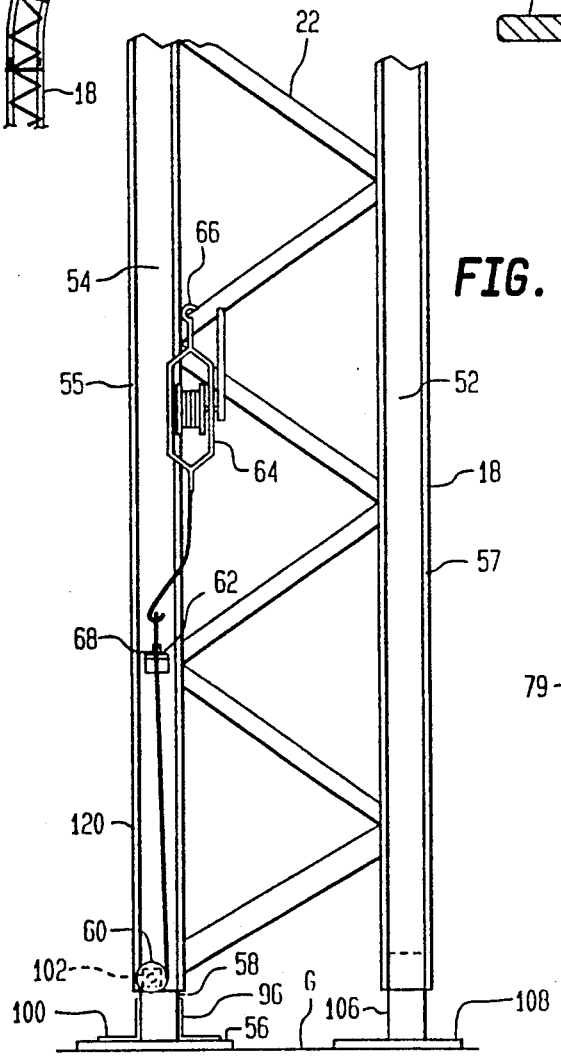
FIG. 6
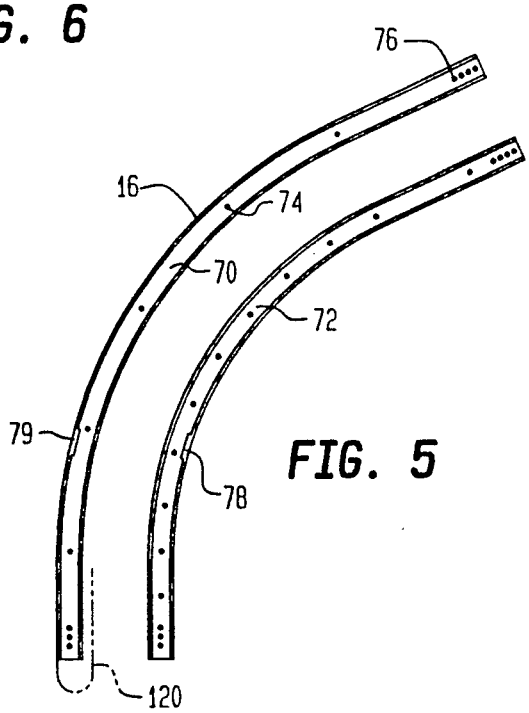
FIG. 5

FIG. 10
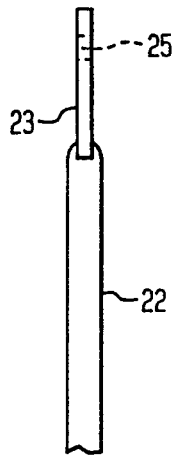
FIG. 9
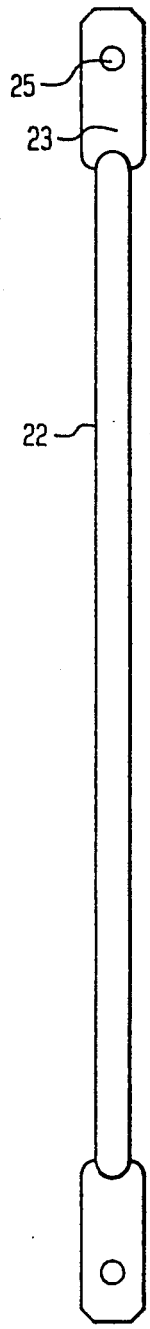
FIG. 7
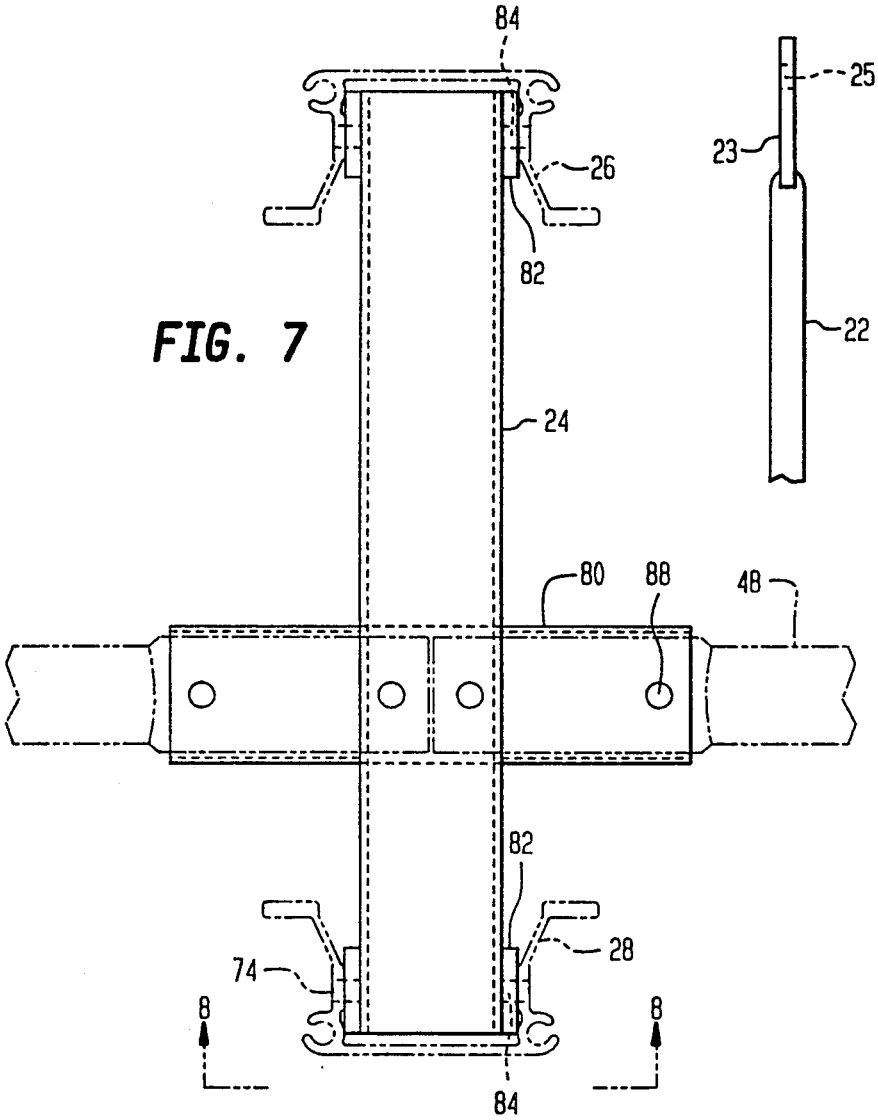
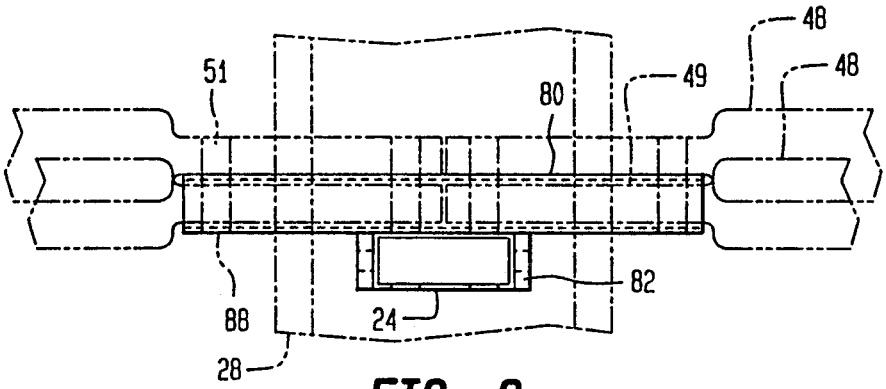
FIG. 8

MODULAR BUILDING STRUCTURE

BACKGROUND OF THE INVENTION

This invention is generally related to modular building structures, and more particularly to a combination fabric membrane and arched truss building structure which is easily deployable on site.

Fabric membrane-type structures are well known in this art. These structures fill the need for an easily deployable cost effective building structure that will withstand the normal heavy loads placed on them by the environment.

These structures typically include a plurality of longitudinal arched aluminum beams with lengths of fabric membrane stretched between each aluminum beam after the aluminum beams are deployed in upright orientation and transversely spaced apart to provide the primary support structure for the building.

The following U.S Patents are known to applicants as teaching a variety of membrane-beam structures as follows:

| | |
|---|---|
| Huddle | Re. 30,044 |
| Huddle | 3,916,638 |
| Huddle | Bl 4,034,772 |
| Sprung | 4,118,904 |
| Sprung | 4,137,687 |
| Huddle | 4,148,332 |
| Stafford et al. | 4,593,710 |

Of particular interest to the present invention is the disclosure of one of the co-inventors, R. Stafford, in U.S. Pat. No. 4,644,706. This patent is directed to a building structure which provides a unique arrangement for tensioning the fabric membrane within entrapping grooves formed into the sides of each arched aluminum beam.

The present invention represents several improvements over the '706 patent, including an improved fabric membrane tensioning arrangement which does not inhibit ingress and egress between these trusses and also provides an improved arch truss structure which is stronger, thus facilitating larger longitudinal truss spans. The present invention also provides a significant step forward in reducing length of time of deployment of the structure.

BRIEF SUMMARY OF THE INVENTION

This invention is directed to a modular ground deployable membrane supporting building structure and arched truss member therefor. The building structure incorporates a plurality of truss members supportable vertically in side-by-side arrangement within a ground anchor connectable at each end of each truss member. Each truss member is comprised of a plurality of frame sections each connectable in aligned abutting end-to-end relation. Each frame section is comprised of inner and outer channel members having a unique U-shaped cross section facilitating cross member connection to secure a spaced parallel relation of the channel members, flexible membrane retention and improved strength and reduced deployment time. An improved membrane tensioning arrangement and ground anchor structure facilitating pivotal deployment of each assembled truss member are also provided. Utilization of galvanized cross members in combination with aluminum extruded channel members further improves truss strength while avoiding galvanic deterioration between these dissimilar metals.

It is therefore an object of this invention to provide a modular ground deployable membrane supporting building structure offering reduced assembly time and improved strength.

It is another object of this invention to provide a modular ground deployable building structure having longer longitudinal spans of the truss members than is presently available.

It is yet another object of this invention to provide an improved arch truss member for membrane supporting building structures offering improved strength and longer spans and which is quickly assemblable and erectable to an upright orientation after partially pivotally connecting each end of the truss member to a ground anchor.

It is yet another object of this invention to provide a truss member for building structures which utilizes a unique aluminum extruded inner and outer channel member held spaced apart by galvanized cross members for improved strength-to-weight ratios.

It is yet another object of this invention to provide an improved means for longitudinally tensioning each member.

In accordance with these and other objects which will become apparent hereinafter, the instant invention will now be described with reference to the accompanying drawings.

BRIEF DESCRIPTION OF THE DRAWINGS

FIG. 3 is a side elevation view of one truss member shown in FIG. 1.

FIG. 4 is a transverse section view of the outer channel member in the direction of arrows 4—4 in FIG. 2.

FIG. 5 is a side elevation view of the inner and outer channels of the base bend frame section shown in FIG. 1.

FIG. 6 is a side elevation view of the lower end of column frame section.

FIG. 7 is a transverse front elevation view of the purlin brackets of the present invention, showing the spaced channel members of FIG. 4 in phantom.

FIG. 8 is a view in the direction of arrows 8—8 in FIG. 7.

FIG. 9 is a typical front elevation view of a cross member and a purlin as shown in FIG. 1.

FIG. 10 is a side elevation view of FIG. 9.

DETAILED DESCRIPTION OF THE INVENTION

Figure 1:
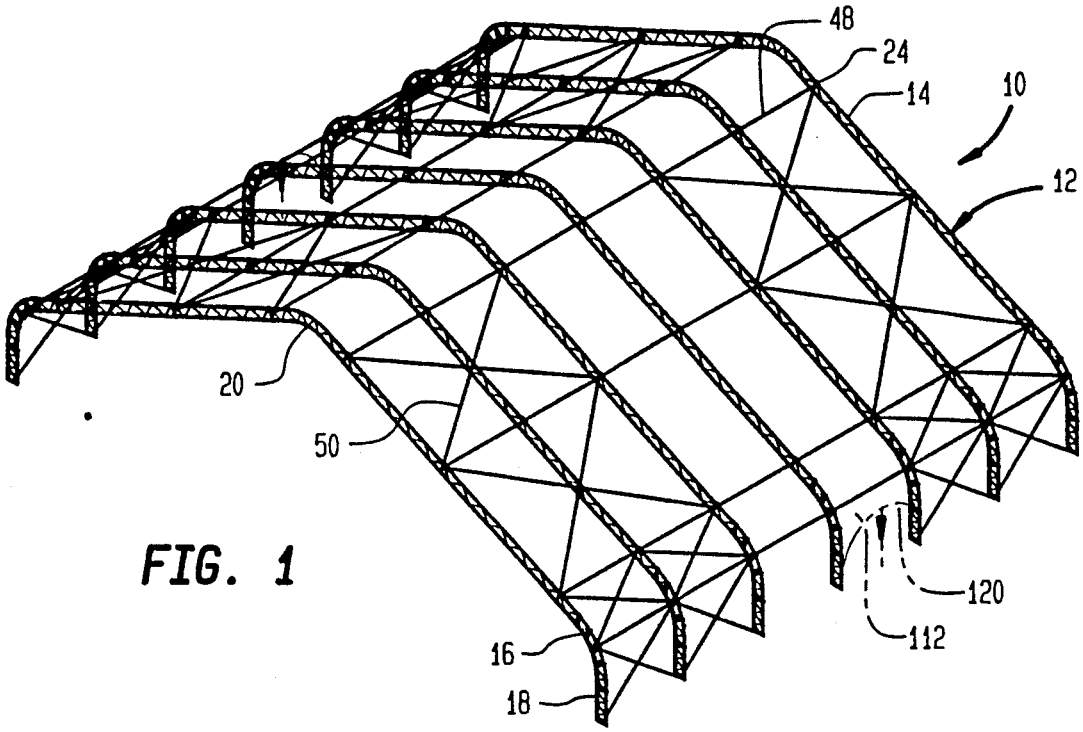
FIG. 1 is a perspective view of the invention.

Referring now to the drawings, and particularly to FIGS. 1 to 5, the invention is shown generally at numeral 10 and includes a plurality of arched truss members 12 which are held in upright transversely spaced relation by ground anchor means which will be described herebelow. Each of the truss members 12 is also interconnected one to another by transversely extending purlins 48. Each of the truss members 12 comprises a variable length column frame section 18, a base bend frame section 16, one or more variable length beam frame sections 14 and an apex frame station 20. All of these frame sections are constructed as will be described herebelow.

Figure 2:
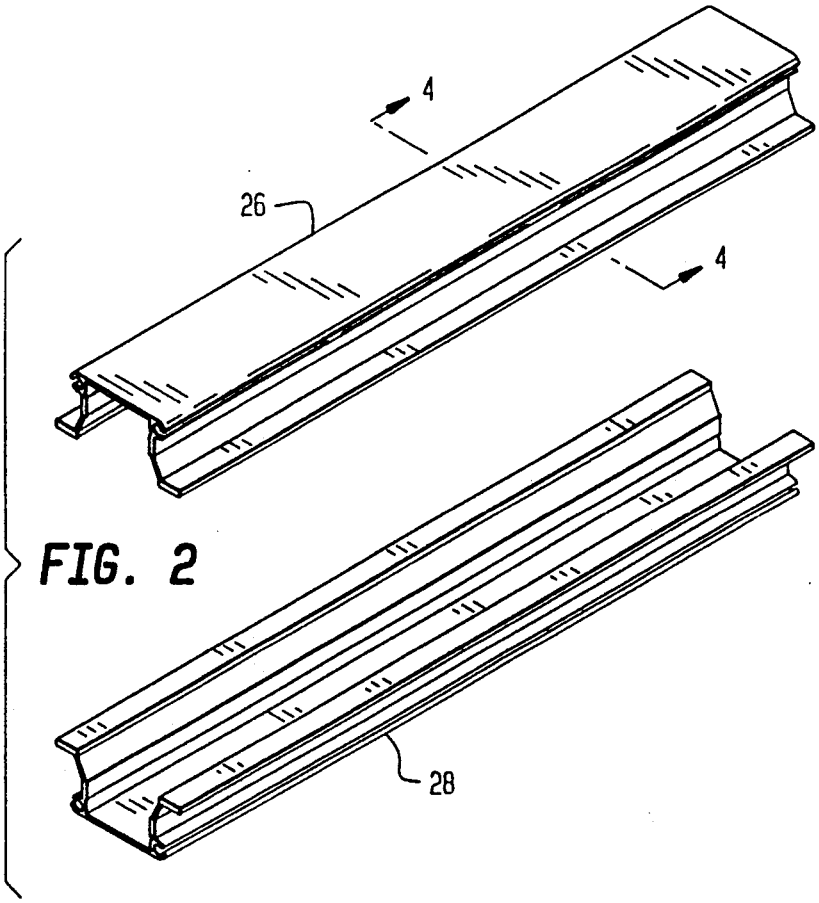
FIG. 2 is a perspective view of the inner and outer channel members of each frame section absent cross members.

As best seen in FIGS. 2 and 4, each of the frame sections is comprised of spaced parallel inner and outer aluminum extruded channel members 28 and 26, respectively. These channel members 26 and 28 are held in spaced apart relation by a plurality of boltable cross members 22 which are described in more detail with respect to FIGS. 9 and 10. These outer and inner channel members 26 and 28, respectively have a cross section which is shown typically in FIG. 4 which are uniquely configured aluminum extrusions, generally U-shaped having their open sides opposingly facing one another. Extending along the outer corners of each channel member 26 and 28 are longitudinal entrapping grooves 32 and 34. These grooves 32 and 34 define a circular cross sectional interior having longitudinal slots or openings 36 and 38 which are narrower than the circular interior.

Flat opposing interior surfaces 40 and 42 are also included to provide a bolting surface for the cross members 22. Small longitudinal recesses 45 and 47 are provided as a guide for bolt hole drilling purposes. For added rigidity, the channel members 26 and 28 also include transversely extending flanges 44 and 46 along their entire length.

As best seen in FIG. 5, the base bend frame member 16, shown as typical, includes outer and inner channel members 70 and 72 having a cross section similar to that described with respect to FIG. 4. A plurality of bolt holes 76 are provided for locking interconnection with an extruded connecting tube for linking each channel member 70 and 72 to the next aligned and abutting channel member of the next frame section. A plurality of bolt holes 74 are also provided for locking connection of the cross members 22 thereto as previously described.

The base bend frame section 16 also includes a flared opening 78 (shown in phantom in FIG. ) and 79 in the entrapping grooves as previously described. The purpose of these flared openings 78 and 79 will be described herebelow with respect to the tensioning of the flexible membrane shown typically at 112 in phantom in FIG. 1 and described in more detail with respect to FIGS. 17 to 19.

Referring additionally to FIGS. 7 and 8, a purlin bracket is also provided formed of a tubular section 24 and having bolting spacers 82 connected to the edge surfaces at the ends thereof as shown and bolted in place through bolt holes 84 which align with bolt holes 74 (typ.). A transversely extending tubular member 80 is connected to member 24, the entire arrangement boltably connectable between outer and inner channel members 26 and 28 (typ.) shown in phantom in FIG. 7. By this arrangement, the purlins 48 shown in phantom may be boltably connected through holes 51 either within or against member 80 as best seen in FIG. 8. These purlins 48 then transversely extend to and connect with purlin brackets of adjacent truss members as seen in FIG. 1.

Referring additionally to FIGS. 9 and 10, the cross brace and purlin construction is shown typically at 22 and includes an elongated straight cylindrical main portion having flattened portions 23 through which both holes 25 are provided.

Figure 11:
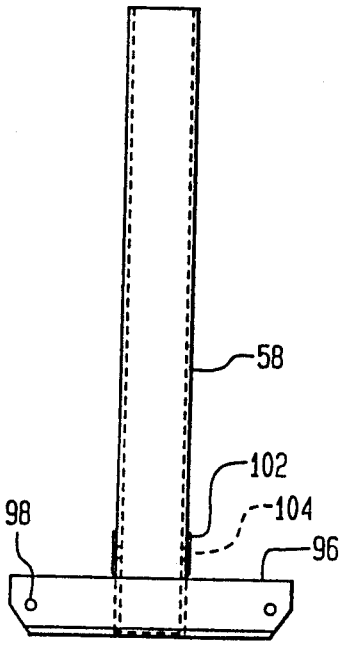
FIG. 11 is a side elevation view of an anchor bracket matably fitable within the lower end of the outer channel member of each column frame section.
Figure 12:
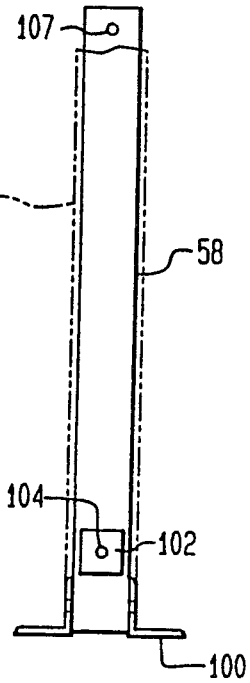
FIG. 12 is an end elevation view of FIG. 11.
Figure 15:
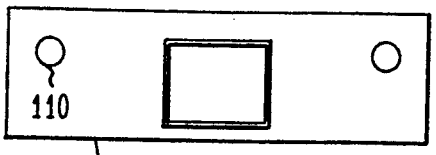
FIG. 15 is a top plan view of the retaining bracket which is matably connectable within the lower end of the inner channel members of each column frame section.
Figure 16:
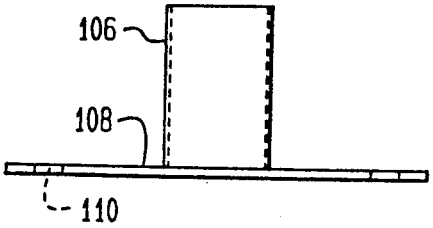
FIG. 16 is a side elevation view of FIG. 15.
Figure 13:
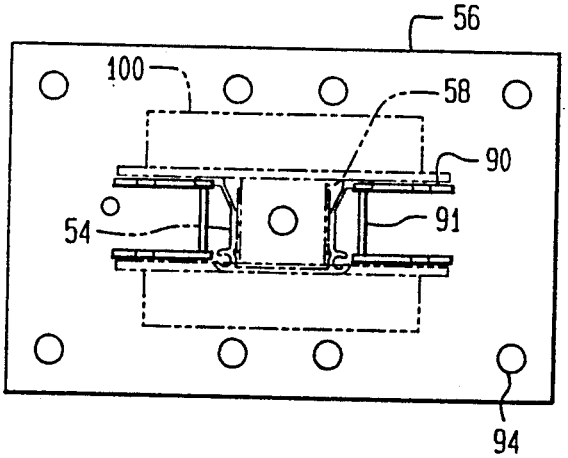
FIG. 13 is a top plan view of a base plate which is matably connectable to the ground beneath the bracket shown in FIG. 11.
Figure 14:
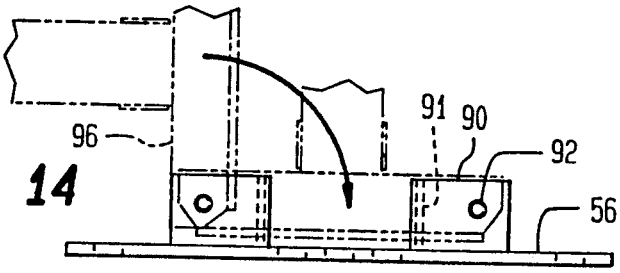
FIG. 14 is a side elevation view of FIG. 13.

Referring now to FIGS. 11 to 16, the ground anchor means for each truss member is there shown and includes an attaching bracket (FIGS. 11 and 12) connectable into the outer channel member 54 shown in phantom in FIGS. 12 and 13 of the column frame section 18, a base plate connectable between the ground and the outer channel member bracket and a combination bracket and base plate 108 for the inner channel member shown in FIGS. 15 and 16. Bracket 96 includes extending support flanges 100 and an upright member 58 which matably engages within outer channel member 54 as seen in FIG. 6. Bolt hole 107 is provided in alignment with a mating hole in channel member 54 to secure this arrangement by bolt (not shown).

Base plate 56 is provided with a plurality of bolt holes 94 for securing the base plate 56 to a concrete anchor buried or cast formed in the ground (not shown). Base plate 56 also includes upwardly extending plates 90 and 91 which are configured to mate within brackets 96 and to be boltably secured therewithin aligned bolt holes 92 and 98. Flanges 100 shown in phantom are supported atop base plate 56.

In FIGS. 15 and 16, the combination anchor bracket and base plate for the inner channel member 52 shown in FIG. 6 is thereshown. Base plate 108 is boltably connectable to a concrete anchor in the ground, while upwardly extending member 106 slidably engages within inner channel member 52 and may be boltably secured in that position.

Referring again to FIG. 14, a unique feature of the anchor means is there shown in phantom wherein bracket 96 and member 58 are shown in phantom in a position which would correspond to the corresponding truss member lying flat atop the ground and wherein one bolt has been secured through the aligned holes 92 and 98. Thereafter, the entire truss member 12 may be pivoted in the direction of the arrow by the use of a crane. By this arrangement, there is no requirement for subsequent realignment of the mating bracket 96 and plates 90 of base plate 56 when the truss member is in an upright orientation. The member 106 of base plate 108 will automatically mate within the inner channel member 52 as the truss member 12 is pivoted into the upright position. Alternately, the inner base plate 108 may be boltably secured to a buried concrete abutment thereafter.

Figure 17:
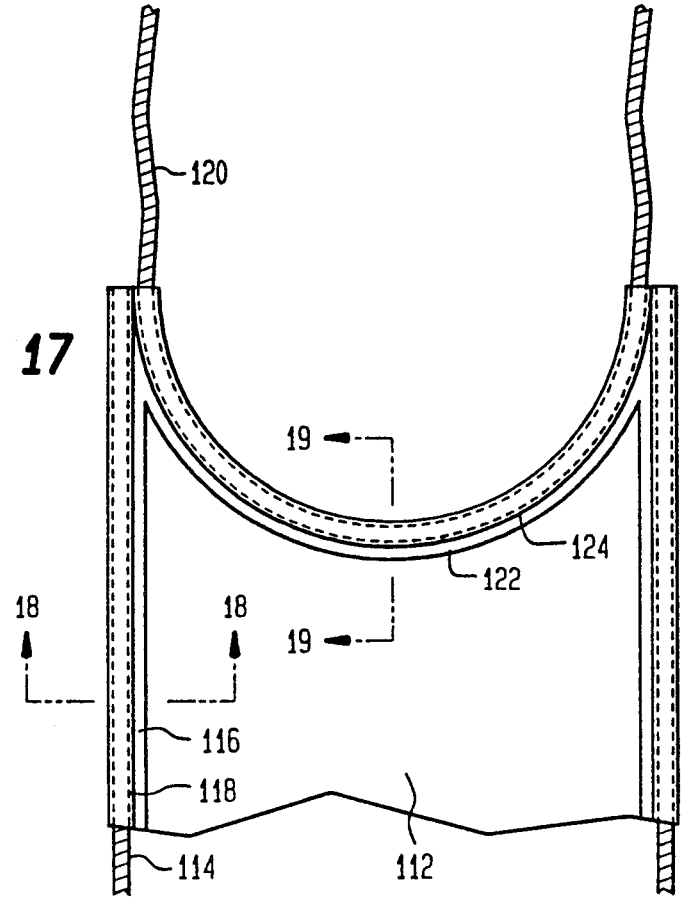
FIG. 17 is a top plan view of a flexible membrane connectable between adjacent truss members.
Figure 18:
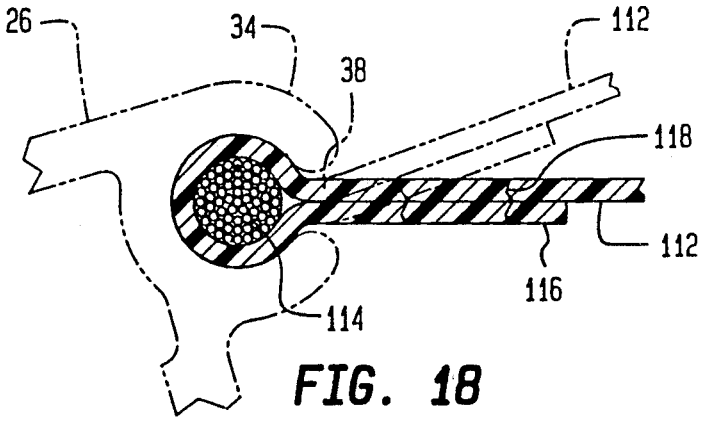
FIG. 18 is a section view in the direction of arrows 18—18 in FIG. 17.
Figure 19:
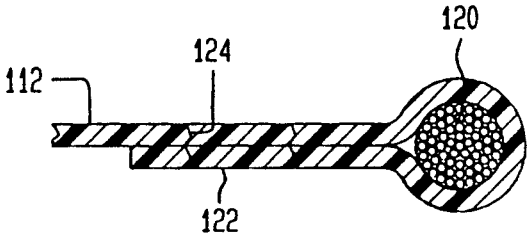
FIG. 19 is a section view in the direction of arrows 19—19 in FIG. 17.

Turning now to FIGS. 17 to 19, the elongated rectangular flexible membrane 112 is there shown and is also shown in phantom in FIG. 1. The material utilized in fabricating this flexible membrane is preferably vinyl coated polyester having a thickness of approximately 0.020". Wrapably connected along each longitudinal margin of the membrane 112 by edge margin 116 are encapsulated lengths of rope 114. The membrane material 112 is tightly wrapped around the rope 114 and then heat sealed along 118 to secure this arrangement. The diameter of rope 114 is such as to, in combination with the thickness of membrane 112, form a retaining bead sized to slidably engage into the groove 34 formed along the outer corner margins of channel members 26 shown in phantom and as previously described. The thickness of the two layers of membrane 112 are such as to slidably pass through slot 38 (in phantom) and allow the membrane 112 to be positioned as shown in phantom in tensioned alignment within the corresponding groove of the channel member of the next adjacent truss member.

Also provided with membrane 112 is an additional length of flexible rope or cable 120 which is heat seal connected in arcuate configuration transversely across each end of the membrane 112 as seen in FIG. 17. Again, heat sealing along 124 secures the transverse margin 122 against the membrane 112. However, the rope 120 is made slidably engageable within the bead formed between membrane 112 and its transverse arcuate margin 122.

The purpose of the tensioning line 120 is best seen in combination with FIGS. 1, 5 and 6 which shows that the free ends of tensioning line 120 extend into flared openings 79 and downwardly within the lower portion of entrapping groove 55 of outer channel member 54 as previously described in FIG. 4. The tensioning line 120 then extends around reversing roller 60 which is held for rotation against plate 102 within bolt hole 104 of member 58 as best seen in FIGS. 11 and 12. The tensioning line 120 then upwardly extends back along channel member 54 through an aperture in bracket 62 connected to channel member 54. A tensioning device 64 held by hook 66 to a cross member 22 is then temporarily connected to the distal end of tensioning line 120. One such tensioning device 64 is utilized for each free end of tensioning line 120 of each flexible membrane 112.

After tensioning line 120 is sufficiently tensioned, a clamp 68 is applied around line 120 against bracket 62 to secure the arrangement. Of course, each transverse end of each flexible membrane 112 must be tensioned accordingly.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

What is claimed is:

1. A modular ground erectable building structure comprising:

a plurality of elongated arched truss members supportable vertically in parallel spaced apart side-by-side arrangement;

a ground anchor supportively connectable to each end of each truss member of said truss member plurality;

each said truss member including a plurality of elongated frame sections connectable in aligned end-to-end abutting relation to form each said truss member; and including an enlarged retaining bead formed along each said longitudinal margin, each said groove configured to slidably secure one said enlarged retaining bead therewithin, said flexible membrane extending transversely out through each said groove along substantially the entire length of each said truss member, said membrane having a width corresponding to the spacing between side-by-side truss members;

a length of flexible line connected and extending arcuately along and freely beyond a transverse end margin of each said membrane;

a flared opening in said groove positioned adjacent an end of one said retaining bead and structured to receive one said line into said groove, each said line extendable from said flared opening downward from and out of said groove;

a reversing roller connected to an end of said truss member for guiding each frame section of said frame section plurality including opposing inner and outer elongated thin-walled channel members each having a generally U-shaped cross-section defining two adjacent spaced corners and an open side;

a plurality of cross braces connectable between and spacing said inner and outer channel members rigidly apart;

said inner and outer channel members of each said frame section having their open sides facing one another;

each said channel member also including a longitudinal entrapping groove positioned along each said corner of said U-shaped cross section and generally coextensive therewith;

each said groove oriented to face a corresponding said groove of an adjacent said truss member to form a pair of grooves;

an elongated rectangular flexible membrane having longitudinal margins each said line around said roller;

a locking bracket and means from tensioning each said line within said locking bracket as said line extends upwardly from said reversing roller;

means for securing each said line in said locking bracket after upward tensioning of said line.

2. A modular building structure as set forth in claim 1, wherein:

said ground anchor includes an inner and outer base plate connectable to the ground and an inner and outer bracket matably connectable to each said inner and outer base plate respectively, and having an upright member insertable into each end of each said inner and outer channel members.

3. A modular building structure as set forth in claim 2, wherein:

each said outer base plate and outer bracket are pivotally connectable and configured in conjunction with a lifting means for pivotal deployment of each said truss member from a horizontal to an upright orientation about said pivotal connection, at which upright position said inner and outer brackets are ready for full locking engagement within the corresponding said inner and outer base plates.

4. A modular building structure as set forth in claim 1, wherein:

a plurality of purlin brackets connectable in spaced positions along the length of each said frame sections between said inner and outer channel members;

each purlin bracket of said purlin bracket plurality configured for connection with a purlin transversely extending in either direction therefrom to the next adjacent corresponding said purlin bracket of the next adjacent truss members.

5. A modular building structure as set forth in claim 4, wherein:

each said channel member includes transversely outwardly extending flanges configured to stiffen and strengthen the open sides of each said U-shaped section.

6. A modular building structure as set forth in claim 5, wherein:

each said channel member is formed of an aluminum extrusion;

said cross braces forming each said frame section with said inner and outer channel members are formed of galvanized steel.

* * * * *

UNITED STATES PATENT AND TRADEMARK OFFICE

CERTIFICATE OF CORRECTION

PATENT NO. : 5,269,106

DATED : December 14, 1993

INVENTOR(S) : Robert Stafford, et al.

It is certified that error appears in the above-indentified patent and that said Letters Patent is hereby corrected as shown below:

Column 5, lines 53-68 and Column 6, lines 1-41, (Claim 1) has been replaced with the following:

A modular ground erectable building structure comprising:

a plurality of elongated arched truss members supportable vertically in parallel spaced apart side-by-side arrangement;

a ground anchor supportively connectable to each end of each truss member of said truss member plurality;

each said truss member including a plurality of elongated frame sections connectable in aligned end-to-end abutting relation to form each said truss member;

each frame section of said frame section plurality including opposing inner and outer elongated thin-walled channel members each having a generally U-shaped cross-section defining two adjacent spaced corners and an open side;

UNITED STATES PATENT AND TRADEMARK OFFICE

CERTIFICATE OF CORRECTION

PATENT NO. : 5,269,106

DATED : December 14, 1993

INVENTOR(S) : Robert Stafford, et al.

It is certified that error appears in the above-indentified patent and that said Letters Patent is hereby corrected as shown below:

Column 5, lines 53-68 and Column 6, lines 1-41, (Claim 1) has been replaced with the following:

a plurality of cross braces connectable between and spacing said inner and outer channel members rigidly apart;

said inner and outer channel members of each said frame section having their open sides facing one another;

each said channel member also including a longitudinal entrapping groove positioned along each said corner of said U-shaped cross section and generally coextensive therewith;

each said groove oriented to face a corresponding said groove of an adjacent said truss member to form a pair of grooves;

an elongated rectangular flexible membrane having longitudinal margins and including an enlarged retaining bead formed along each said longitudinal margin, each said groove configured to slidably secure one said enlarged retaining bead therewithin, said flexible membrane extending transversely out through each said groove along substantially the entire length of each said truss member,

UNITED STATES PATENT AND TRADEMARK OFFICE

CERTIFICATE OF CORRECTION

PATENT NO. : 5,269,106

DATED : December 14, 1993

INVENTOR(S) : Robert Stafford, et al.

It is certified that error appears in the above-indentified patent and that said Letters Patent is hereby corrected as shown below:

Column 5, lines 53-68 and Column 6, lines 1-41, (Claim 1) has been replaced with the following:

said membrane having a width corresponding to the spacing between side-by-side truss members;

a length of flexible line connected and extending arcuately along and freely beyond a transverse end margin of each said membrane;

a flared opening in each said groove positioned adjacent an end of one said retaining bead and structured to receive one said line into said groove, each said line extendable from said flared opening downward from and out of said groove;

a reversing roller connected to an end of said truss member for guiding each said line around said roller;

a locking bracket and means for tensioning each said line within said locking bracket as said line extends upwardly from said reversing roller;

UNITED STATES PATENT AND TRADEMARK OFFICE

CERTIFICATE OF CORRECTION

PATENT NO. : 5,269,106

DATED : December 14, 1993

INVENTOR(S) : Robert Stafford, et al

It is certified that error appears in the above-indentified patent and that said Letters Patent is hereby corrected as shown below:

means for securing each said line in said locking bracket after upward tensioning of said line.

Signed and Sealed this

Second Day of August, 1994

Bruce Lehman

*Attest:*

BRUCE LEHMAN

*Attesting Officer*

*Commissioner of Patents and Trademarks*